United States Patent [19]

Janesh

[11] 4,419,779

[45] Dec. 13, 1983

[54] PILLOW CONSTRUCTION AND METHOD

[76] Inventor: Larry Janesh, 3326 Lenox, Youngstown, Ohio 44502

[21] Appl. No.: 366,718

[22] Filed: Apr. 8, 1982

[51] Int. Cl.[3] ..... A47G 9/00

[52] U.S. Cl. ..... 5/490; 5/434

[58] Field of Search ..... 5/434, 436, 490, 440, 5/441, 442, 491; D6/201, 204

[56] References Cited

U.S. PATENT DOCUMENTS 2,008,285 7/1935 Kraus ..... 5/490

3,968,529 7/1976 Levin et al. ..... 5/437

4,286,345 9/1981 Matier ..... 5/434

FOREIGN PATENT DOCUMENTS 179233 5/1906 Fed. Rep. of Germany ..... 5/490

*Primary Examiner*—Alexander Grosz

*Attorney, Agent, or Firm*—Harpman & Harpman

[57] ABSTRACT

A pillow construction that is formed by multiple folds of outwardly extending portions of similar shaped material arranged offset and opposite one another in a fold-over lapping relationship defining an enclosure, the face of which is open for the insertion of a separate patterned insert.

5 Claims, 7 Drawing Figures

PILLOW CONSTRUCTION AND METHOD

BACKGROUND OF THE INVENTION (1) Technical Field

This invention relates to construction of pillows which are used for comfort and ornamentation. Pillows of this type are constructed fabric sewn together in a variety of appealing shapes and filled with a soft stuffing of artificial or natural fillers, such as feathers.

(2) Description of the Prior Art

Prior art pillows are formed of pieces of fabric sewn together or folded and then sewn to form different shapes and fabric patterns. See for example U.S. Pat. Nos. 2,008,285, 3,968,529 and 4,286,345.

In U.S. Pat. No. 2,008,285 a receptacle of textile fabric is disclosed wherein identical pieces of material are sewn together one on top of another along two sides and combined with a similar sewn pair. The two pairs are combined, sewn along opposite open edges to form a matching back and front pattern for the construction of the pillow.

U.S. Pat. No. 3,968,529 shows a pillow construction having a plurality of triangular sections joined to one another in an elongated chain pattern which are then folded into a hexagon shape and secured to one another.

U.S. Pat. No. 4,286,345 discloses a quasi-octagonal pillow wherein identical rectangular sections are sewn together forming a pattern having four outstanding square portions, each of which is folded over its lower portion so that three-fourths of each rectangular section extends inwardly on itself defining a generally circular shape pillow when viewed from above.

In applicant's pillow construction the outwardly extending portions are rectangular with their longitudinal edges defining the square shape of the pillow. Each of the outwardly extending portions is folded along its longitudinal edge and then back in an offcenter triangular shape in relation to the overall shape of the pillow. The overlapping triangles define an opening in the face of the pillow in which a separate patterned piece of material can be inserted under the edges of the triangles.

SUMMARY OF THE INVENTION

A pillow construction having an open face into which an insert of fabric can be placed under the edges of multiple overlapping triangles having folded exposed edges. The overlapping configuration is achieved by folding over rectangular outwardly extending portions along their longitudinal edges. The pillow can be formed from one piece of material with very little sewing. The open face design allows for a variety of inserts allowing the pillow to be changed according to the environment in which it will be placed.

DESCRIPTION OF THE PREFERRED EMBODIMENT

Figure 2:
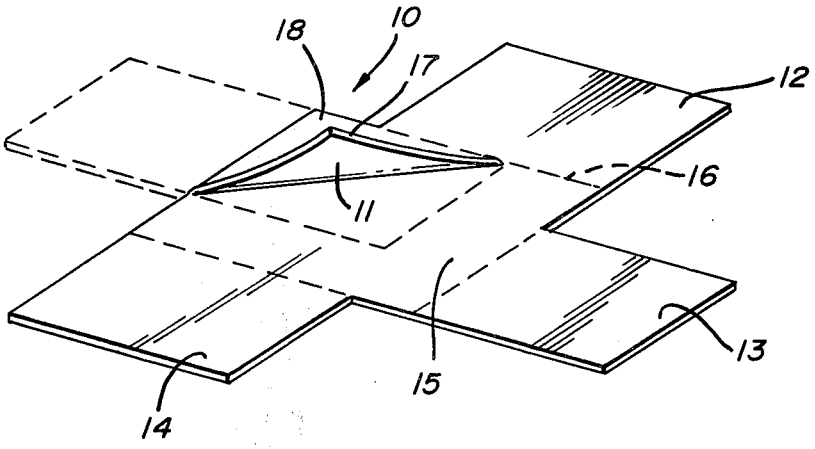
FIG. 2 is a perspective view showing the arrangement of the initial patterned material.
Figure 3:
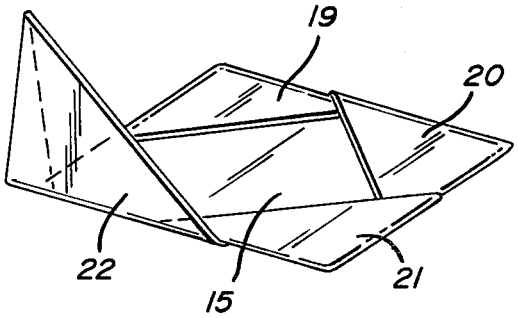
FIG. 3 is a perspective view illustrating the folding steps of the pillow construction.

Referring now to FIGS. 2 and 3 of the drawings, a pillow construction comprising a pattern panel of material 10 having four outwardly extending portions 11, 12, 13 and 14, each of which is generally square and positioned longitudinally to define a square center portion 15, indicated by the dotted line 16. The four outwardly extending portions 11–14 are of a length less than that of the square center portion 15. The pattern panel of material 10 can be cut from a single piece of material or assembled out of multiple sections.

Figure 4:
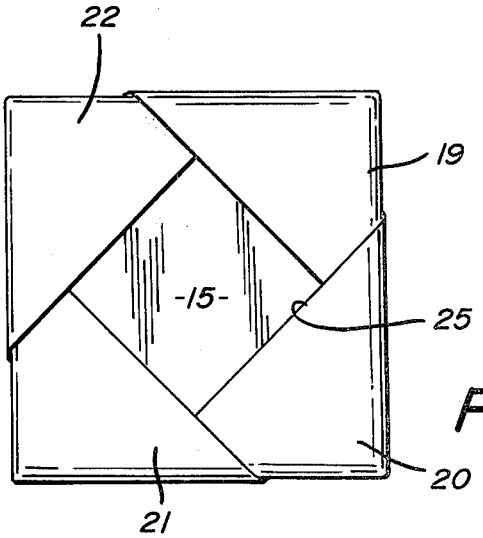
FIG. 4 is a top plan view of the completed pillow.

To assemble the pillow, each of the outwardly extending portions 11–14 are folded one at a time beginning with the portion 11 inwardly on the dotted line 16. Then an innermost corner 17 of the folded portion 11 is folded back upon itself to the opposite corner 18 defining a triangle 19. Each of the outwardly extending portions 11–14 are folded in a similar manner and form respective triangles 20, 21 and 22 as best seen in FIG. 3 of the drawings. The folding of each outwardly extending portion 11–14 in the above-described method assures that each of the triangles 19–22 overlaps the triangle adjacent one another. The outer edges of the triangles 19–22 are sewn in place and turned inside out completing the assembly as seen in FIG. 4 of the drawings.

Figure 1:
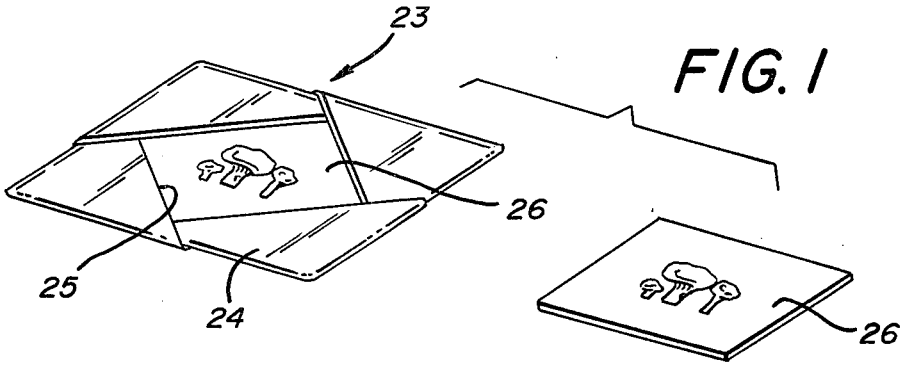
FIG. 1 is a perspective view of the completed pillow and insert without a filler.

The above-referred to assembly defines a pillow 23 seen in FIG. 1 of the drawings having a face 24 with an opening at 25. An insert piece 26 having a design or pattern thereon is of a size so that it can be placed within the opening at 25 and under the folded portions of the triangles 19–22 holding the insert 26 in place.

Filling or stuffing for the pillow 23 is placed in a smaller enclosure, not shown, which is inserted first in the opening 25 followed by the decorative insert 26 as described above.

Figure 5:
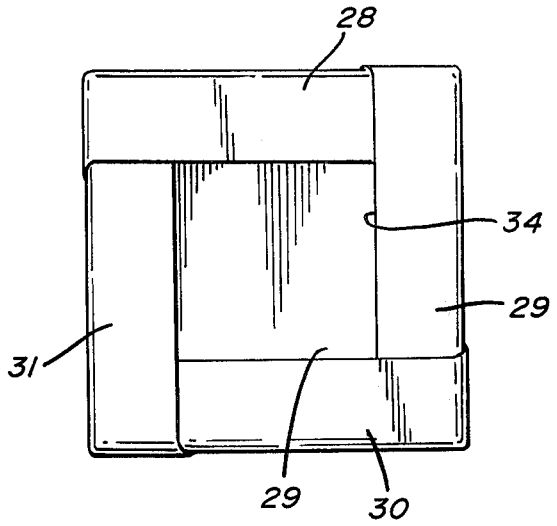
FIG. 5 is a top plan view of an alternate form of the pillow construction.
Figure 6:
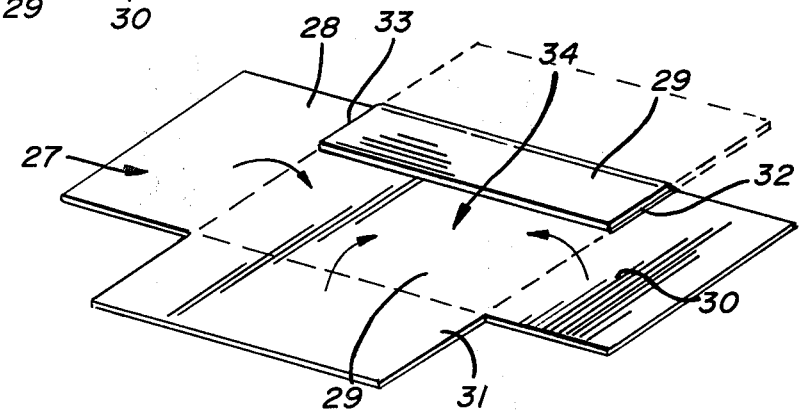
FIG. 6 is a perspective view of the alternate form illustrating the folding steps.

Referring now to FIGS. 5 and 6 of the drawings, an alternate form of the pillow construction can be seen. A fabric pattern 27 in FIG. 6 of the drawings has a plurality of outwardly extending portions 28, 29, 30, and 31 all of an equal length in relation to a center square portion 29. The outwardly extending portions 28–31 have a length greater than their width having ends 32 and 33 respectively. Each of the outwardly extending portions 28–31 are folded inward then outward on a dotted line 30 in an alternating overlapping configuration as seen in FIG. 5 of the drawings. The perimeter is sewn in place and turned inside out leaving a face 34 open to accept a pattern insert, not shown, similar to that hereinbefore described.

Figure 7:
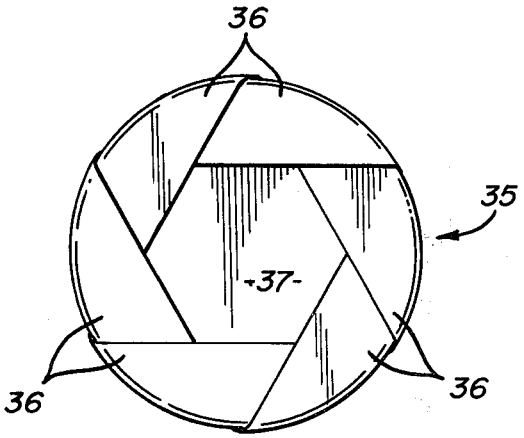
FIG. 7 is a top plan view of a second alternate form of the pillow construction.

In FIG. 7 of the drawings, a second alternate form of the invention is shown wherein a round pillow configuration 35 has a plurality of folded segments 36 around its perimeter edge. In this alternate form of the invention, the segments 36 are cut individually and folded in half being sewn in place overlapping one another to a circular backing 37. The segments 36 are arranged to form an open face 37 into which can be positioned a circular insert material, not shown, having a pattern in the same manner as was described above.

Thus it will be seen that a new and useful pillow construction has been described and that it will be obvious to those skilled in the art that various changes and modifications may be made therein without departing from the spirit of the invention.

Having thus described my invention what I claim is:

1. A pillow construction comprising a plurality of outwardly extending portions, each of a length equal to its width, each of said outwardly extending portions being joined along one longitudinal edge to a square center portion in an offset oppositely disposed relation to one another with the longitudinal edge of said outwardly extending portions of a length less than that of said square center portion and greater than that of one-half the length of said center portion, each of said outwardly extending portions being folded to define a triangle with its free edges parallel with and joined to said square center portion, a decorative insert placed within an area defined by said triangles.

2. The pillow construction of claim 1 wherein the length of the free edges of said triangles are of a greater than one half of the length of one side of said square portion.

3. The pillow construction of claim 1 wherein said triangles overlap a portion of each adjacent triangle.

4. The pillow construction of claim 1 wherein said outwardly extending portion and said square portions are of an integral one piece material.

5. A method of manufacturing a pillow incorporating four outwardly extending portions and a square portion comprising the steps of sewing together the outwardly extending portions and the square portions along the longitudinal edges of each, folding each outwardly extending portion on to said square portion, folding each of said outwardly extending portions back upon itself in a diagonal manner defining a triangle, the free ends of which abut the perimeter of said square portion, sewing together said free ends of the triangles to the folded portion of said outwardly extending portions, the triangles arranged in an overlapping configuration defining an opening, turning said construction inside out, thereby defining a pillow shape and, placing an insert under the triangles which define the opening.

* * * * *